United States Patent [19]

Tsuji et al.

[11] Patent Number: 4,585,179

[45] Date of Patent: Apr. 29, 1986

[54] PORTABLE CRUSHER

[75] Inventors: Yoshihiro Tsuji, Kaizuka; Fumio Fujihara, Neyagawa; Yoichi Nishikawa, Uji, all of Japan

[73] Assignee: Kurimoto Ltd., Osaka, Japan

[21] Appl. No.: 615,536

[22] Filed: May 31, 1984

[30] Foreign Application Priority Data

Jun. 2, 1983 [JP] Japan ..... 58-98882

[51] Int. Cl.[4] ..... B02C 21/02

[52] U.S. Cl. ..... 241/101.7; 241/285 B

[58] Field of Search ..... 241/101.7, 101.2, 285 R, 241/285 A, 285 B

[56] References Cited

U.S. PATENT DOCUMENTS

| | | | |
|---|---|---|---|
| 4,010,665 | 3/1977 | Kidd | 241/101.7 X |
| 4,101,081 | 7/1978 | Ritter et al. | 241/101.7 |
| 4,383,651 | 5/1983 | Couperus | 241/101.7 X |

*Primary Examiner*—Mark Rosenbaum

*Attorney, Agent, or Firm*—Wenderoth, Lind & Ponack

[57] ABSTRACT

A movable crushing apparatus has two skids with wheels. The main skid carrying a crusher and a feeder is adapted to lie on the ground when in use. When moving the apparatus to other place, the point where the two skids are coupled with each other is raised off the ground by a hydraulic jack.

2 Claims, 6 Drawing Figures

PORTABLE CRUSHER

BACKGROUND OF THE INVENTION

1. Field of the Invention

The present invention relates to an improved portable crushing apparatus adapted to be moved by a tractor.

2. Description of the Prior Art

In recent years, the load-and-carry method has been used at a quarry or the like. In the method, a primary crushing apparatus is installed near a working face and stones are carried by a shovel loader to the crushing apparatus and dumped into it. In such a method, a self-propelling crushing apparatus with a crawler or a portable crushing apparatus adapted to be carried to a work place by a tractor is used.

FIG. 1 shows a conventional self-propelling crushing apparatus which has a crawler 1, a frame 2 mounted on the crawler 1, a crusher 3 mounted on the frame 2, a feeder 4 with a hopper 5 provided at the rear of the frame 2 to carry the material to be crushed to the crusher 3, a swivel conveyor 6 provided at the front of the frame 2 to discharge the crushed material out of the apparatus, and a discharge conveyor 7 for carrying the crushed material from the crusher 3 to the swivel conveyor 6.

Since such a self-propelling crushing apparatus has a crusher 3 and all the necessary equipment mounted on the crawler 1, the entire apparatus is of a considerable height and a long feeder 4 is required. Another problem is that the load due to the vibration of the crusher 3 is always applied to the crawler 1, affecting unduly its operation. This puts a limitation on the size of the crusher. Also, the use of a crawler increases the cost of the entire apparatus.

Further, such a conventional crushing apparatus has some shortcomings about its operation. Because of high position of the hopper, an inclined or raised portion 8, from which the material to be crushed is dumped by a shovel loader 9 into the hopper 5, has to be placed on the ground. This decreases the rate of efficient operation. Further, when moving the crushing apparatus from one location to another, the old raised portion 8 has to be leveled off and another raised portion has to be installed at the new location. This step also results in a substantial decrease in the work efficiency.

FIG. 2 shows another conventional crushing apparatus which has two trucks 10, 11 with wheels 12, 13, respectively, having rubber tires. One truck 10 carries a crusher 3 and another truck 11 carries a hopper 5' and a feeder 4'.

This apparatus, too, is of a considerable height and requires a long feeder 4'. Thus, a raised portion 8 is needed. Further, in this type, alignment of the trucks 10, 11 to each other is very troublesome. It takes much time to align the supply port of the crusher 3 with a discharge port of the feeder 4'.

SUMMARY AND OBJECT OF THE INVENTION

An object of the present invention is to provide a portable crushing apparatus which obviates such shortcomings and in which the material can be dumped into a hopper from a shovel loader on the ground without the necessity of using an incline.

In accordance with the present invention, the crushing apparatus includes two separate skids having wheels, one of them carrying a crusher and a feeder adapted to be lowered down to the ground for the crushing work and to be raised above the ground when moving the entire apparatus. Since the rear skid carrying heavy equipment such as a crusher and a feeder is adapted to be laid on the ground, the weight and vibration of such equipment are not applied to the wheels. Since the crusher is mounted at a considerably lower level than in the conventional apparatus, a long feeder is not required any more. The material to be crushed can be dumped by use of an ordinary shovel loader on the ground. In other words, a raised portion does not have to be made any more.

Other objects and features of the present invention will become apparent from the following description taken with reference to the accompanying drawings.

DETAILED DESCRIPTION OF THE PREFERRED EMBODIMENTS

Figure 1:
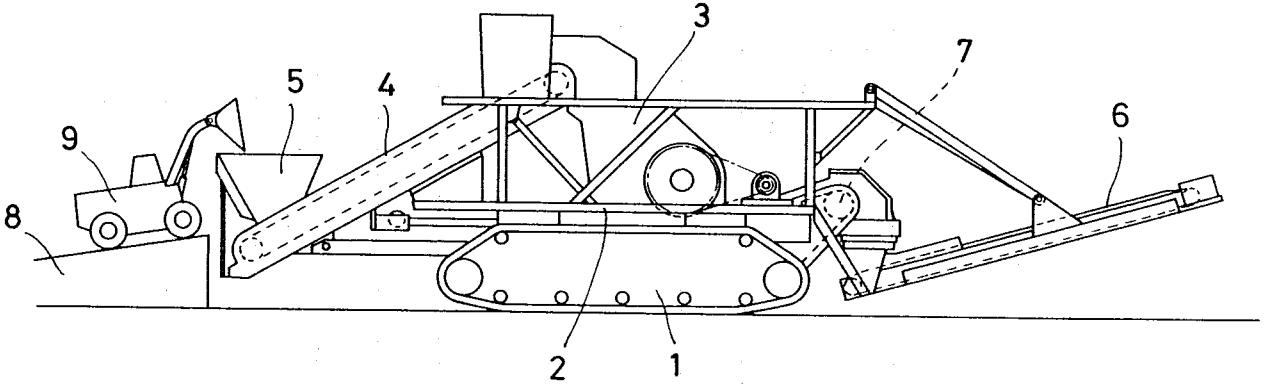
FIG. 1 PRIOR ART
FIGS. 1 and 2 are side views of two examples of conventional crushing apparatus.
Figure 2:
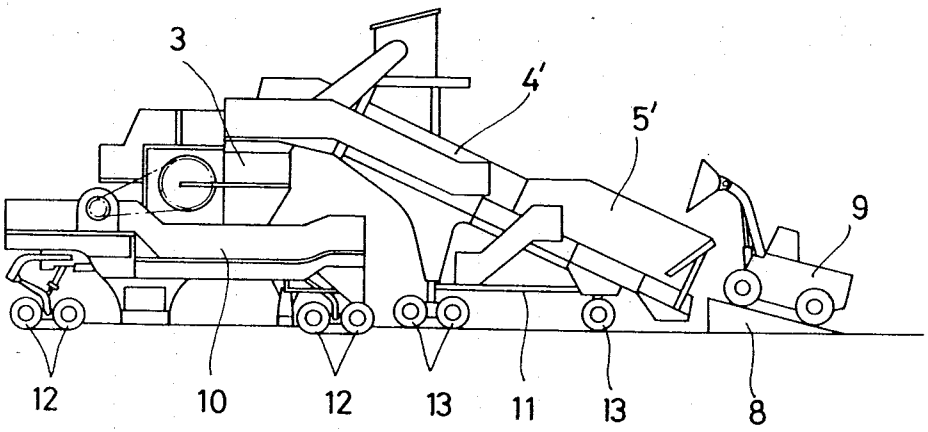
FIG. 2 PRIOR ART
Figure 3:
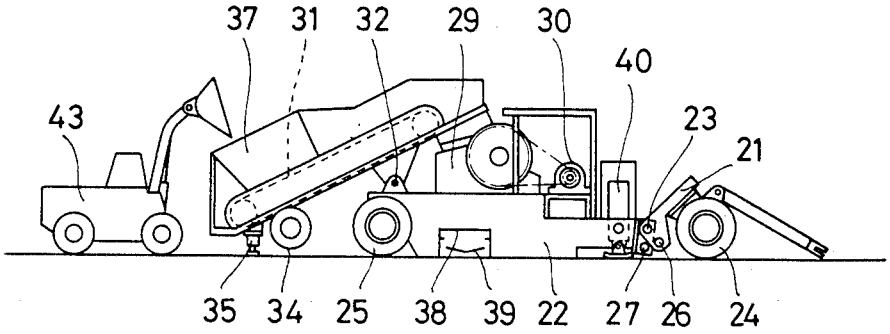
FIG. 3 is a side view of the preferred embodiment of the present invention showing it in use.

Referring to FIG. 3 showing a preferred embodiment, it has a front skid 21 and a rear skid 22 which are pivotally coupled to each other by a coupling pin 23. The skids 21, 22 are provided with a pair of wheels 24, 25, respectively, having rubber tires. The skids 21, 22 are adapted to be fixedly coupled to each other by aligning pin holes 26, 27 in the skids 21, 22 with each other and putting a lock pin 28 (FIG. 4 only) into these holes 26, 27.

Figure 6:
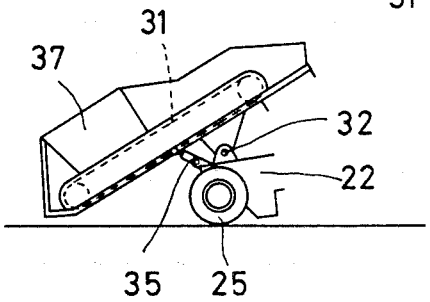
FIG. 6 is a partial side view of another embodiment.

A crusher 29 and its drive means 30 are mounted on the rear skid 22. A feeder 31 is also mounted thereon so as to be pivotable around a coupling pin 32. In the embodiment of FIG. 3 a pair of wheels 34 with rubber tires and a hydraulic jack 35 are provided on the underside of the feeder 31 at its rear. The hydraulic jack 35 may have its lower end attached to the rear skid 22 as shown in the second embodiment of FIG. 6.

A hopper 37 is mounted on the feeder 31 as shown in FIG. 3. The rear skid 22 is formed with a recess 38 in its bottom. Into the recess 38, the rear end of a discharge conveyor 39 is inserted to discharge the crushed material from the crusher 29. The rear skid 22 is provided with a hydraulic jack 40 at each side thereof to raise its front portion.

Figure 4:
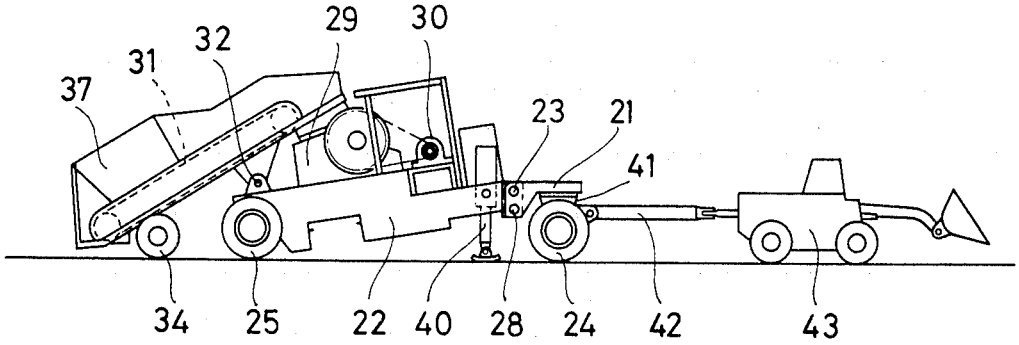
FIG. 4 is a similar side view of the same embodiment showing it when moved to another place.
Figure 5:
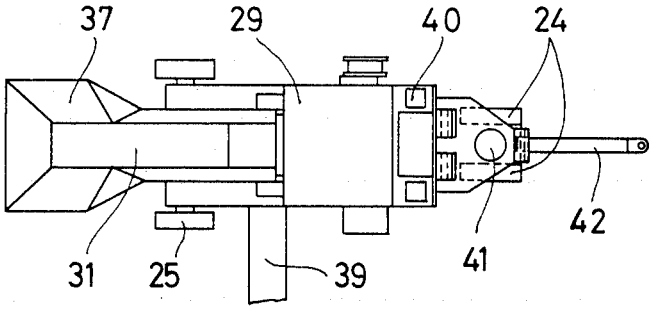
FIG. 5 is a plan view of the same embodiment.

A swivel table 41 shown in FIG. 4 is mounted on the underside of the front skid 21. Wheels 24 for the front skid 21 are mounted on the swivel table 41. A drawbar 42 coupled to the front of the swivel table 41 is adapted to be removably coupled to the rear of a shovel loader 43.

In use, as shown in FIG. 3, the rear skid 22 is allowed to lie on the ground with the hydraulic jacks 40 lowered and the lock pin 28 (FIG. 4) removed. The wheels 34 for the feeder 31 are slightly above the ground with the hydraulic jack 35 on the ground.

With the apparatus in the state of FIG. 3, the material to be crushed can be easily dumped from the shovel loader 43 into the hopper 37 because the hopper 37 is located at a considerably lower level than in the conventional apparatus. No raised portion or incline 8 is required for the shovel loader 43. The crushed material is discharged by the conveyor 39 out of the apparatus.

When moving the apparatus to another place, the hydraulic jack 35 is removed to lower the wheels 34 on to the ground, as shown in the embodiment of FIGS. 3 and 4. In the second embodiment of FIG. 6, the hydraulic jack 35 is extended to raise the rear end of the feeder 31 off the ground. Then, as shown in FIG. 4, it may be seen that the front portion of the rear skid 22 is raised by the hydraulic jack 40 to bring the pin hole 27 (FIG. 3) into alignment with the pin hole 26 (FIG. 3) in the skid 21. The lock pin 28 (FIG. 4) is put in the pin holes 26, 27 (FIG. 3) to integrally couple the skids 21, 22 to each other. Then, the hydraulic jack 40 is shrunk and the entire apparatus is pulled by the shovel loader 43 as shown in FIG. 4.

What we claim is:

1. A movable crushing apparatus comprising:

a first skid having a pair of wheels and also having at least one pin hole at a rear end thereof;

a second skid having a pair of wheels and also having at least one pin hole at a front end thereof;

a crusher fixedly mounted on the second skid;

means, pivotally mounted on the second skid, for receiving material at a rear end and for feeding said material at a front end to the crusher;

lock pin means, inserted into the at least one pin hole at the rear end of the first skid and also simultaneously into the at least one pin hole at the front end of the second skid, for coupling the first skid and the second skid fixedly together end-to-end when moving the entire apparatus from one location to another;

first jack means, connected to one of the first and second skids, for elevating the rear end of the first skid and the front end of the second skid off the ground to allow coupling of the first skid and the second skid fixedly together end-to-end and to move said crusher into an inoperative position; and second jack means, connected to the receiving and feeding means, for elevating the rear end of said receiving and feeding means off the ground into an operative position.

2. The movable crushing apparatus, according to claim 1, wherein:

said receiving and feeding means has a pair of wheels at its rear end.

* * * * *